United States Patent [19]

Tourneur

[11] 4,303,900

[45] Dec. 1, 1981

[54] WIDE BAND WAVEGUIDE WITH DOUBLE POLARIZATION AND ULTRA-HIGH FREQUENCY CIRCUIT INCORPORATING SUCH A WAVEGUIDE

[75] Inventor: Jacky Tourneur, Paris, France

[73] Assignee: Thomson-CSF, Paris, France

[21] Appl. No.: 139,123

[22] Filed: Apr. 10, 1980

[30] Foreign Application Priority Data

Apr. 13, 1979 [FR] France ..... 79 09493

[51] Int. Cl.[3] ..... H01P 3/123; H01P 1/161

[52] U.S. Cl. ..... 333/239; 333/251

[58] Field of Search ..... 333/21 R, 21 A, 239, 333/248, 251

[56] References Cited

U.S. PATENT DOCUMENTS

| | | | |
|---|---|---|---|
| 3,002,163 | 9/1961 | Kahn | 333/21 R |
| 3,150,333 | 9/1964 | Bowman | 333/125 |
| 3,569,870 | 3/1971 | Foldes | 333/215 X |
| 3,758,882 | 9/1973 | Mörz | 333/248 X |

FOREIGN PATENT DOCUMENTS

| | | |
|---|---|---|
| 1013338 | 8/1957 | Fed. Rep. of Germany . |
| 2116441 | 7/1972 | France . |
| 2294554 | 12/1974 | France . |

OTHER PUBLICATIONS

IEEE Transactions on Microwave Theory and Techniques, vol. MTT 22, Aug. 1974, pp. 801-804.

IEEE Transactions on Microwave Theory and Techniques, vol. MTT 15, Aug. 1967, pp. 483-485.

IEEE Transactions on Antennas and Propagation, Mar. 1976, pp. 220-223.

*Primary Examiner*—Paul L. Gensler

*Attorney, Agent, or Firm*—Oblon, Fisher, Spivak, McClelland & Maier

[57] ABSTRACT

The invention relates to a double polarization wide band waveguide.

The waveguide according to the invention comprises a polygonal waveguide having a symmetry of order 4 with respect to a center of symmetry. The waveguide is provided with a plurality of conductive ridges located on the inner face of the sides of the waveguide in accordance with a symmetry of order 4 with respect to the center of symmetry and with a central conductive core, whose cross-section has the same symmetry of order 4n with respect to the center of symmetry.

6 Claims, 7 Drawing Figures

FIG_2-a

FIG_2-b

FIG_3-a

FIG_3-b

FIG_4-a

FIG_4-b

WIDE BAND WAVEGUIDE WITH DOUBLE POLARIZATION AND ULTRA-HIGH FREQUENCY CIRCUIT INCORPORATING SUCH A WAVEGUIDE

FIELD OF THE INVENTION

1. Background of the Invention

The present invention relates to wide band ultrahigh frequency waveguides permitting the transmission under identical conditions of cut-off frequency and impedance of two orthogonal electromagnetic polarization waves or electric field direction.

2. Description of the Prior Art

In wide band waveguides, i.e. waveguides used in a frequency band range above the normal pass band of the waveguide, the appearance of interfering transmission modes, particularly when using such waveguides in a pass band substantially above 30% of the mean frequency of the waveguide, dangerously interfers with the operation of the latter. Thus, in a homogeneous waveguide, there is a double countable infinity of modes likely to be transmitted, i.e. the modes called the TE and TM modes or E-modes and H-modes respectively. Each transmission mode has a cut-off frequency below which transmission takes place with attenuation. The range of use of a waveguide or pass band is the range of frequencies separating the lowest cut-off frequency, called the fundamental mode, from the following cut-off frequency, called the first mode of higher order. In this range, the only possible transmission mode is that of the fundamental mode.

The pass band is defined by the ratio:

$$B\% = \frac{\lambda c2 - \lambda c1}{\lambda c2 + \lambda c1} \times 200$$

in which $\lambda c2$ and $\lambda c1$ are cut-off wavelengths of the fundamental mode and the first mode of a higher order.

The constraint of the double polarization makes it necessary for the cross-section of the guide to accept the longitudinal axis of the waveguide as the axis of symmetry of the order 4n in which n is the random integer $\geqq 1$, a symmetry of order 4n with respect to said longitudinal axis being a symmetry such that a rotation about said same axis of the waveguide cross-section by an angle of $2\pi/4n$ does not change the properties of the waveguides, the polarization of the waveguide being unchanged overall.

However, a given mode is only transmitted if the conditions necessary for this excitation exist, the $TE_{20}$ mode, an asymmetric mode, not appearing in a waveguide in which conditions of radio transmission symmetry conditions are maintained, even when they are beyond the cut-off frequency of the $TE_{20}$ mode. However, a bend in the guide able to create an asymmetry leads to the appearance of the $TE_{20}$ mode. Thus, a guide can only be used outside its pass band under very special conditions of mechanical and/or radio symmetry.

Different solutions have been proposed with a view to increasing the pass band without bringing about the appearance of interfering modes of a higher order. One solution consisting of adding a ridge to the waveguide structure has not made it possible in the case of circular or square guides to obtain an increase in the pass band which is as great as in the case of a rectangular guide. Such results were published in particular in connection with studies carried out by M. H. CHEN, G. N. TSANDOULAS and F. G. WILLWERTH, entitled "Modal characteristics of quadruple-ridged circular and square waveguides", published in the Journal Transactions on Microwave Theory and Techniques, vol. MTT 22, pages 801 to 804, August 1974.

Another solution consisting of introducing square ridges into the dihedral angles formed by the sides of a square waveguide made it possible to obtain a 38% pass band. This type of waveguide can be used on a band octave with only one $TE_{20}$ intefering mode, designated as the $TE_{201}$ mode obtained when the degeneracy between the $TE_{20}$ mode and the $TE_{02}$ mode of a square guide is removed by adding ridges. Such a solution was published by J. J. STALZER, M. D. GREENMAN and F. G. WILLWERTH in a publication entitled "Modes of crossed rectangular waveguide" in the Journal IEEE Transactions on Antenna and Propagation, pages 220 to 223, March 1976.

In various solutions, the addition of ridges to circular or orthogonal square waveguides has never made it possible to exceed a pass band of 40%.

Another solution consists of adding a central conductive core to rectangular waveguides. Such a solution was more particularly described in an article by L. GRUNER entitled "Higher order modes in rectangular waveguides" and published in the Journal IEEE Transactions on Microwave Theory and Techniques (Correspondence), Volume MTT 15, pp. 483 to 485, August 1967.

BRIEF SUMMARY OF THE INVENTION

The present invention makes it possible to obviate the disadvantages referred to hereinbefore and to obtain pass bands higher than 60%.

Another object of the present invention is the realization of a wide band waveguide with double polarization in which the band width is directly related to the geometrical parameters of the waveguide.

According to the invention, the wide band waveguide with double polarization comprises a polygonal waveguide which has, with respect to a centre of symmetry C, a symmetry of order 4n in which n is a random integer. The wide band waveguide has within the polygonal waveguide on the one hand a plurality of conductive ridges, whose cross-section determines with the polygonal cross-section a transmission section of the waveguide. Each of the ridges is placed on the inner face of the sides of the waveguide in accordance with a symmetry of order 4 with respect to said same centre of symmetry. The longitudinal plane of symmetry of each of the ridges is oriented, in the waveguide transmission section, in the direction of the bisectors of the main axes of the waveguide. The wide band waveguide also has a central conductive core, whose cross-section has, compared with the same centre of symmetry, the same symmetry of order 4n.

The waveguide according to the invention can be used in any connection system or ultra-high frequency circuits used in the transmission of signals with a wide frequency band.

BRIEF DESCRIPTION OF THE DRAWINGS

The invention is described in greater detail hereinafter relative to non-limitative embodiments and the attached drawings in which the dimensions and relative proportions of the various elements have not been maintain in order to give a better overall understanding.

DETAILED DESCRIPTION OF THE PREFERRED EMBODIMENTS

Figure 1:
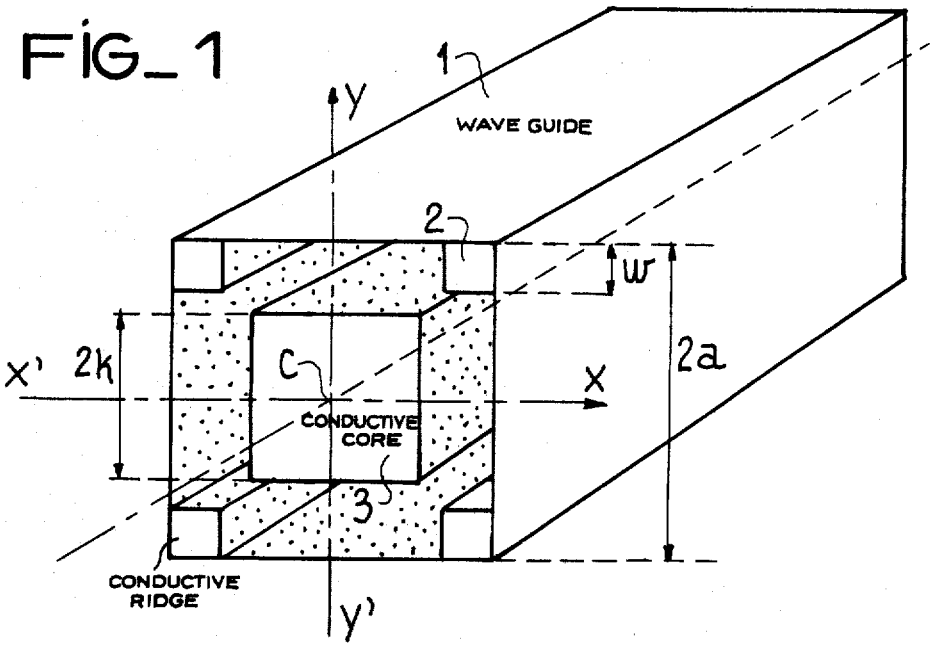
FIG. 1 shows a wide band waveguide with double polarization according to the invention.

According to FIG. 1, the wide band double polarization wave guide according to the invention comprises a polygonal waveguide 1 which has, compared with a central of symmetry C, a symmetry of order 4n in which n is a random integer. The waveguide according to the invention has within the polygonal waveguide a plurality of conductive ridges 2, whereof the section determines with the polygonal cross-section a propagation section of the waveguide. Each of the ridges is placed on the inner face of the sides of the waveguide in accordance with a symmetry of order 4 compared with the centre of symmetry C. The longitudinal plane of symmetry of each of the ridges is oriented, in the waveguide transmission section, in the direction of the bisectors of the principle axes of the waveguide. In FIG. 1, the principle axes of the waveguide are indicated by the axes X'X and Y'Y, their orientation corresponding respectively to the direction of the electric fields of transmission modes $TE_{10}$ and $TE_{01}$ for the waveguide in question. In FIG. 1, the longitudinal plane of symmetry of each ridge is not shown so as not to overburden the drawing. The waveguide according to the invention has on the one hand within the polygonal waveguide a central conductive core 3 and relative to the centre of symmetry C its section has the same symmetry of order 4n, whilst the sections of the conductive central core and of the polygonal waveguide are homothetic with respect to the centre of symmetry C.

In FIG. 1, the polygonal waveguide has a square cross-section of side 2*a* which, compared with the centre of symmetry C has a symmetry of order 4. Within each dihedral angle formed by two consecutive sides of the square cross-section, the waveguide has a conductive ridge 2 with a square section of side W. The four ridges arranged in the section of the waveguide at the end of the diagonals of said section determine with the square section of the waveguide a transmission section of the latter having a symmetry of order 4 compared with the same centre of symmetry C. According to the invention, the polygonal waveguide also has a central conductive core 3, whose square section of side 2*k* has the same symmetry of order 4 compared with the same centre of symmetry C. Thus, the diagonals of the square section of waveguide 1 and the diagonals of the section of the central conductive core coincide.

Figure 2:
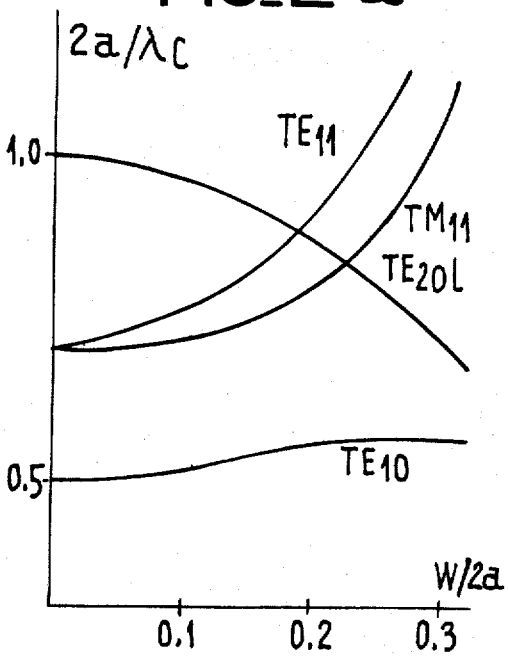
FIGS. 2*a* and 2*b* respectively show the variations in the cut-off frequencies on the one hand for a waveguide with diagonal ridges only and on the other hand for a waveguide with a conductive central core only.
Figure 2:
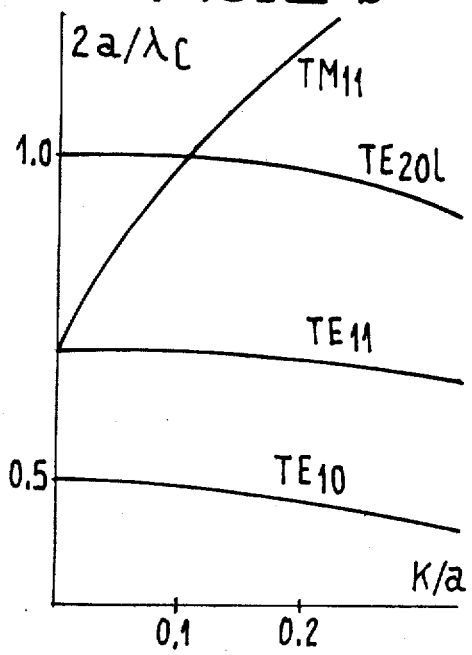

The operation of the waveguide according to the invention is as follows with respect to FIGS. 2*a* and 2*b* in which FIG. 2*a* has a coordinate system, whose ordinates are graduated in standardized cut-off frequency for the ratio of the guide dimensions according to FIG. 1 to the cut-off wavelength of the same guide, the standardized cut-off frequency being designated $2a/\lambda c$ and whose abscissas are graduated by the relationship of the side dimensions of ridge W to the same dimension 2*a* of the waveguide. FIG. 2*a* shows variations in the cut-off frequencies of the higher order transmission modes, such as modes $TE_{11}$, $TM_{11}$, $TE_{201}$ and $TE_{10}$. In the same way, FIG. 2*b* shows on a coordinate system on the ordinates the standardized cut-off frequencies of the waveguide, the ordinate axis being graduated in values of the ratio $2a/\lambda c$ in which 2*a* represents the side dimension of the square section of the waveguide according to FIG. 1 and $\lambda c$ the corresponding cut-off wavelength as a function of the ratio of the dimension of the central conductive core of the square section of side 2*k* related to the same dimension of the square wave guide and side 2*a*. FIG. 2*b* shows the different standardized cut-off frequencies for the higher order modes such as $TM_{11}$, $TE_{201}$, $TE_{11}$ and $TE_{10}$. FIGS. 2*a* and 2*b* respectively show that in the case of the square wave guide only having ridges within each dihedral angle formed by two consecutive sides of the square section the $TM_{11}$ mode limits the pass band whilst the ratio W/2*a* remains below 0.22, the $TE_{201}$ mode substantially becoming the first interfering mode for values above this ratio. FIG. 2*b* shows that in the case of the square guide having a central core, which also has a square section, the only higher order mode limited to the pass band is the $TE_{11}$ mode, whose cut-off frequency is only slightly dependent on the ratio k/a. According to the invention, the simultaneous use of the transmission characteristics of the guide only having ridges, such as shown in FIG. 2*a* and the transmission characteristics of the square guide having a square central conductive core as shown in FIG. 2*b* makes it possible to obtain, in the manner shown in FIGS. 3*a* and 3*b* a rejection towards the frequencies higher than the cut-off frequency of the $TM_{11}$ mode and a parabolic variation as a function of the ratio W/a of the cut-off frequency for the $TE_{11}$ mode. The pass band of this guide is a function of the ratios W/a and k/a, the geometrical parameters of the guide according to the invention. For a given value k/a there is an optimum ratio W/a for which the pass band is maximum. The value of the pass band BW obtained by realizing the waveguide according to the invention as shown in FIG. 1 is given in the following table, as a function of the values of ratios k/a and W/a.

| k/a | W/a | BW % |
|---|---|---|
| 0.0 | 0.44 | 38% |
| 0.2 | 0.36 | 57% |
| 0.3 | 0.36 | 61% |
| 0.4 | 0.32 | 64.5% |
| 0.5 | 0.26 | 66% |
| 0.6 | 0.22 | 60% |

Figure 3:
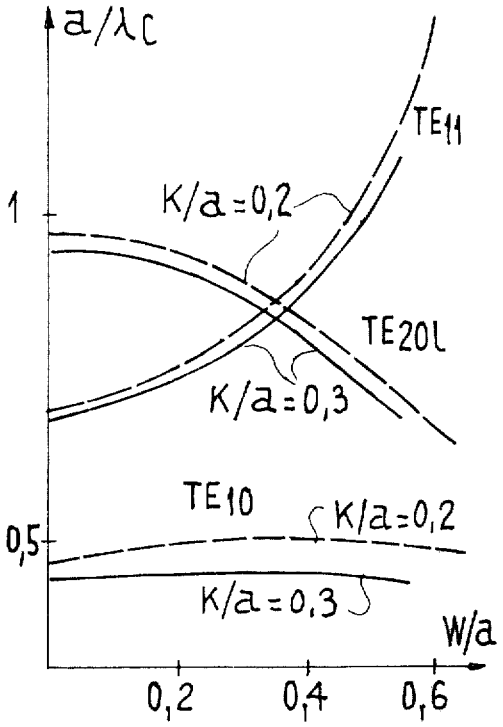
FIGS. 3*a* and 3*b* show the variation in the cut-off frequency of the waveguide in accordance with the embodiment of the invention as shown in FIG. 1, as a function of the geometrical parameters of the embodiment in question.
Figure 3:
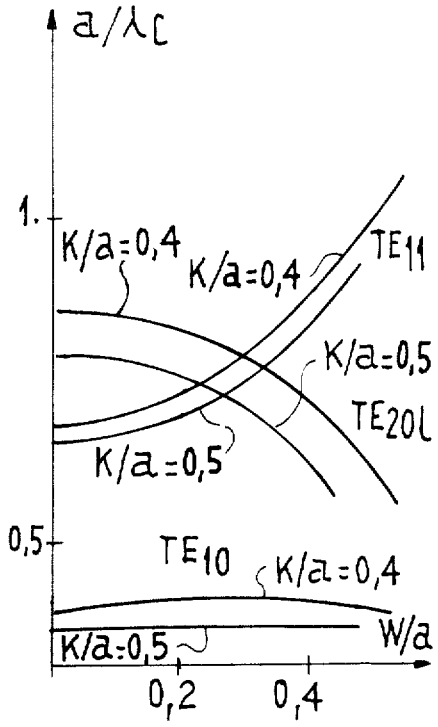

For different values of the ratio k/a FIGS. 3*a* and 3*b* show the variations in the standardized cut-off frequencies $a/\lambda c$, the ratio of the half-dimensions of the square wave guide to the cut-off wavelength of the guide, as a function of the ratio W/a, dimension of the side of the section of the square ridge related to the same half-dimension of the section of the waveguide.

The waveguide according to the invention makes it possible to obtain a higher pass band than that of the guides hitherto used for solving identical problems. The pass band of the guide according to the invention, a function of the ratios k/a and W/a, reaches a value of 66% when these ratios have as their respective values 0.5 and 0.26.

Figure 4:
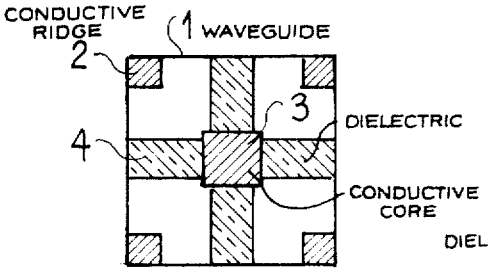
FIGS. 4*a* and 4*b* show a front view of a section along a plane orthogonal to the longitudinal axis of the waveguide of the embodiment of FIG. 1 in accordance with two constructional variants.
Figure 4:
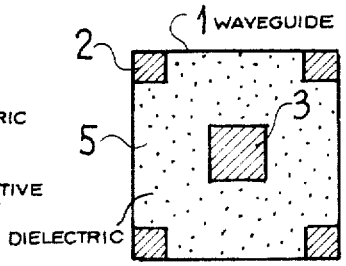

According to FIG. 4*a*, the waveguide according to the invention also has a plurality of dielectric spacers 4 making it possible to keep the central conductive core in position. According to the constructional variant of FIG. 4*b*, the waveguide according to the invention has within the guide a dielectric material foam 5 making it possible to keep the central conductive core in position. Any constructional variant of a system for holding the central conductive core in position can be used without passing beyond the scope of the invention. As an example, the main cut-off frequencies of a guide, for which the respective dimensions were a=20 mm, W/a=0.3 and k/a=0.5 were for the $TE_{10}$ mode $Fc(TE_{10})=5.588$ GHz, for the $TE_{11}$ mode $Fc(TE_{11})=11.300$ GHz and for the $TE_{201}$ mode $Fc(TE_{201})=10.808$ GHz. For determined parameter values, value of the ratios W/a and k/a, the problem of seeking the cut-off frequencies of the waveguide modes can be summarized by the solving of the two-dimensioned HELMHOLTZ equation in the cross-section of the guide. Two preferred methods can be used.

A first method, the RAYLEIGH-RITZ method, permits a polynomial calculation of the field. A second method, the method using finite elements, makes it possible to obtain more precise calculations by a longer and more costly process. Thus, a double polarization, wide band waveguide has been described which can in particular be used in any ultra-high frequency circuit and particularly in wide band ultra-high frequency connecting circuits.

What is claimed is:

1. A wide band waveguide with double polarization comprising a polygonal waveguide having, with respect to a center of symmetry C, a symmetry of the order 4n in which n is a random integer, and which is such that a rotation of the cross-section about said center of symmetry by an angle of $2\pi/4n$ does not change properties of the waveguide, wherein on the one hand a polarity of conductive ridges, whose cross-section determines with the polygonal section a transmission section of the waveguide, is provided on the inner face of the sides of the waveguide in accordance with a symmetry of the order 4 with respect to said center of symmetry, the longitudinal plane of symmetry of each ridge being oriented, in the waveguide transmission section, in the direction of the bisectors of the principal axis of the waveguide, and on the other hand within the waveguide a central conductive core is provided, whose section has a same symmetry of the order 4n with respect to said center of symmetry.

2. A wide band waveguide with double polarization comprising a waveguide with a square section of side 2*a* having, with respect to the center of symmetry, a symmetry of the order 4, that is such that a rotation of the cross-section about said center of symmetry by an angle of $\pi/2$ does not change the properties of the waveguide, wherein it is provided with, on the one hand within each dihedral angle formed by two consecutive sides of the square sections, a diagonal conductive ridge of square section and side W determining, with the square section of the waveguide a transmission section of the waveguide having, with respect to said center of symmetry a symmetry of order 4 and on the other hand a central conductive core, whose square section of side 2*k* has a symmetry of order 4 with respect to said centre of symmetry.

3. A waveguide according to claim 2, wherein the ratio of the side dimension of ridge W, relating to the half-dimension a of the waveguide side has a value between 0.22 and 0.36.

4. A waveguide according to claim 2, wherein the ratio of the side dimension of the section of central core 2k, related to the side dimension 2*a* of the square section of the waveguide, has a value between 0.2 and 0.6.

5. A waveguide according to claim 2, wherein it has a plurality of dielectric spacers making it possible to keep the conductive central core in position.

6. A waveguide according to claim 2, wherein it has a dielectric material foam which keeps the central conductive core in position.

* * * * *